US006188855B1

(12) United States Patent
Fujioka

(10) Patent No.: US 6,188,855 B1
(45) Date of Patent: Feb. 13, 2001

(54) TONER CARTRIDGE CAPABLE OF PREVENTING SEALING FILM FROM BREAKING

(75) Inventor: Satoshi Fujioka, Niigata (JP)

(73) Assignee: NEC Corporation, Tokyo (JP)

( * ) Notice: Under 35 U.S.C. 154(b), the term of this patent shall be extended for 0 days.

(21) Appl. No.: 09/258,635

(22) Filed: Feb. 26, 1999

(30) Foreign Application Priority Data

Feb. 27, 1998 (JP) ..... 10-047381

(51) Int. Cl.[7] ..... G03G 15/08
(52) U.S. Cl. ..... 399/106
(58) Field of Search ..... 399/102, 106

(56) References Cited

U.S. PATENT DOCUMENTS 5,778,282 * 7/1998 Nagashima ..... 399/106

FOREIGN PATENT DOCUMENTS

| | | |
|---|---|---|
| 60-95561 | 5/1985 | (JP) . |
| 61-93469 | 5/1986 | (JP) . |
| 1-172067 | 12/1989 | (JP) . |
| 1-315779 | 12/1989 | (JP) . |
| 2-61672 | 3/1990 | (JP) . |
| 2-150872 | 6/1990 | (JP) . |
| 3-5774 | 1/1991 | (JP) . |
| 3-129369 | 6/1991 | (JP) . |
| 3-168671 | 7/1991 | (JP) . |
| 3-112766 | 11/1991 | (JP) . |
| 4-35158 | 3/1992 | (JP) . |
| 4-242567 | 8/1992 | (JP) . |
| 4-278971 | 10/1992 | (JP) . |
| 5-142942 | 6/1993 | (JP) . |
| 5-289513 | 11/1993 | (JP) . |
| 6-130814 | 5/1994 | (JP) . |
| 6-314026 | 11/1994 | (JP) . |
| 7-146608 | 6/1995 | (JP) . |
| 7-168444 | 7/1995 | (JP) . |
| 8-16066 | 1/1996 | (JP) . |
| 8-292634 | 11/1996 | (JP) . |
| 9-22240 | 1/1997 | (JP) . |
| 9-197792 | 7/1997 | (JP) . |
| 10-39603 | 2/1998 | (JP) . |
| 10-221940 | 8/1998 | (JP) . |

* cited by examiner

*Primary Examiner*—William J. Royer
(74) *Attorney, Agent, or Firm*—Ostrolenk, Faber, Gerb & Soffen, LLP

(57) ABSTRACT

A toner cartridge has a developing chamber and a toner chamber which are divided by a partition. The partition has a step on a main surface facing to the developing chamber and has a toner supplying opening for supplying toners from the toner chamber to developing chamber. A side wall is fixed to the partition to partially provide the developing chamber. The side wall has a drawing opening for drawing a sealing film which seals the toner supplying opening. The step is located between the toner supplying opening and the drawing opening. When the sealing film is drawn from the developing chamber through the drawing opening, toners on the sealing film are gathered by a bent section of the sealing film. The step forms a escape space so that the gathered toners escape from the bent section. The sealing film is smooth drawn out of the developing chamber, because the gathered toners escape from the bent section through the escape space.

16 Claims, 11 Drawing Sheets

TONER CARTRIDGE CAPABLE OF PREVENTING SEALING FILM FROM BREAKING

BACKGROUND OF THE INVENTION

This invention relates to a toner cartridge used in an electrophotographic printer, such as a laser printer, an LED printer, a copying machine, or a facsimile apparatus.

An electrophotographic printer consumes toners to print characters, pictures, etc. on a paper or the like. Because the toners are expendable supplies, it is necessary to replenish new toners to continue a printing operation of the electrophotographic printer. However, the replenishing of the toners brings some problems. Therefore, a toner cartridge holding the toners is realized to make the replenishing easy. Such a toner cartridge is, for example, disclosed in a Japanese Unexamined Patent Publication No. Tokkaihei 6-130814.

A conventional toner cartridge has a body that provides a developing chamber for containing a developing machine and a toner chamber for holding toners. The body includes a side wall which partially defines the developing chamber. The side wall has a drawing opening which leads to the developing chamber. The developing chamber and the toner chamber are partitioned by a flat partition, which partially defines the drawing opening. The partition has a toner supplying opening to supply the toners from the toner chamber to the developing chamber. The toner supplying opening is sealed or closed with a sealing film at a side of the developing chamber when the toner cartridge is in an unused state. The sealing film has a ribbon shape comprising first and second parts that are continuous with each other. The first part has a first end at one end of the sealing film and the second part has a second end at the other end of the sealing film. The first part is pasted to the partition to close the toner supplying opening. The first part is easily peeled from the partition. In this state, the first end is located near the drawing opening. The sealing film is bent at the boundary area between the first part and the second part to lay the second part on the first part. The second end is located out of the body through the drawing opening. The sealing film must be peeled from the partition and removed from the developing chamber when the toner cartridge is used in the electrophotographic printer. This is carried out by drawing the second end.

If the second end is drawn, the first part is gradually peeled from the partition and the toner supplying opening opens from one side to the other side. In this event, the toners held by the toner chamber partially pour into the developing chamber and fall on the sealing film. At the same time, a bent section of the sealing film moves on the first part to the first end. Thus, the bent section gathers the fallen toners on the first part toward the first end. The gathered toners have nowhere to go and prevent the sealing film from completely passing through the drawing opening. As a result, the sealing film breaks in two and one of the broken sealing films remains in the developing chamber.

SUMMARY OF THE INVENTION

The present invention overcomes the problems in the prior art by providing a toner cartridge with a sealing film that is easily removed from a developing chamber.

The invention also provides a toner cartridge with a sealing film that is completely removed from a developing chamber.

The invention also provides a toner cartridge capable of preventing a sealing film from breaking in two.

Other features of this invention will become clear as the description proceeds.

On describing the gist of this invention, it is possible to understand that a toner cartridge is for use in an electrophotographic printer. The toner cartridge has a developing chamber and a toner chamber holding toners.

According to the invention, the toner cartridge comprises a partition that is located between the developing chamber and the toner chamber to divide the developing chamber and the toner chamber. The partition has a main surface facing the developing chamber and has a toner supplying opening through the main surface to supply the toners from the toner chamber to the developing chamber. A sealing film is pasted on the main surface to close the toner supplying opening and to seal the toners into the toner chamber in an unused state. The sealing film can be peeled from the main surface. A side wall is practically perpendicularly fixed to the partition to partially define the developing chamber and has a drawing opening to draw the sealing film out of the developing chamber. An escape member is formed on the partition between the toner supplying opening and the drawing opening to make toners escape from the sealing film when the sealing film is drawing out through the drawn opening.

DESCRIPTION OF THE PREFERRED EMBODIMENTS

Figure 1:
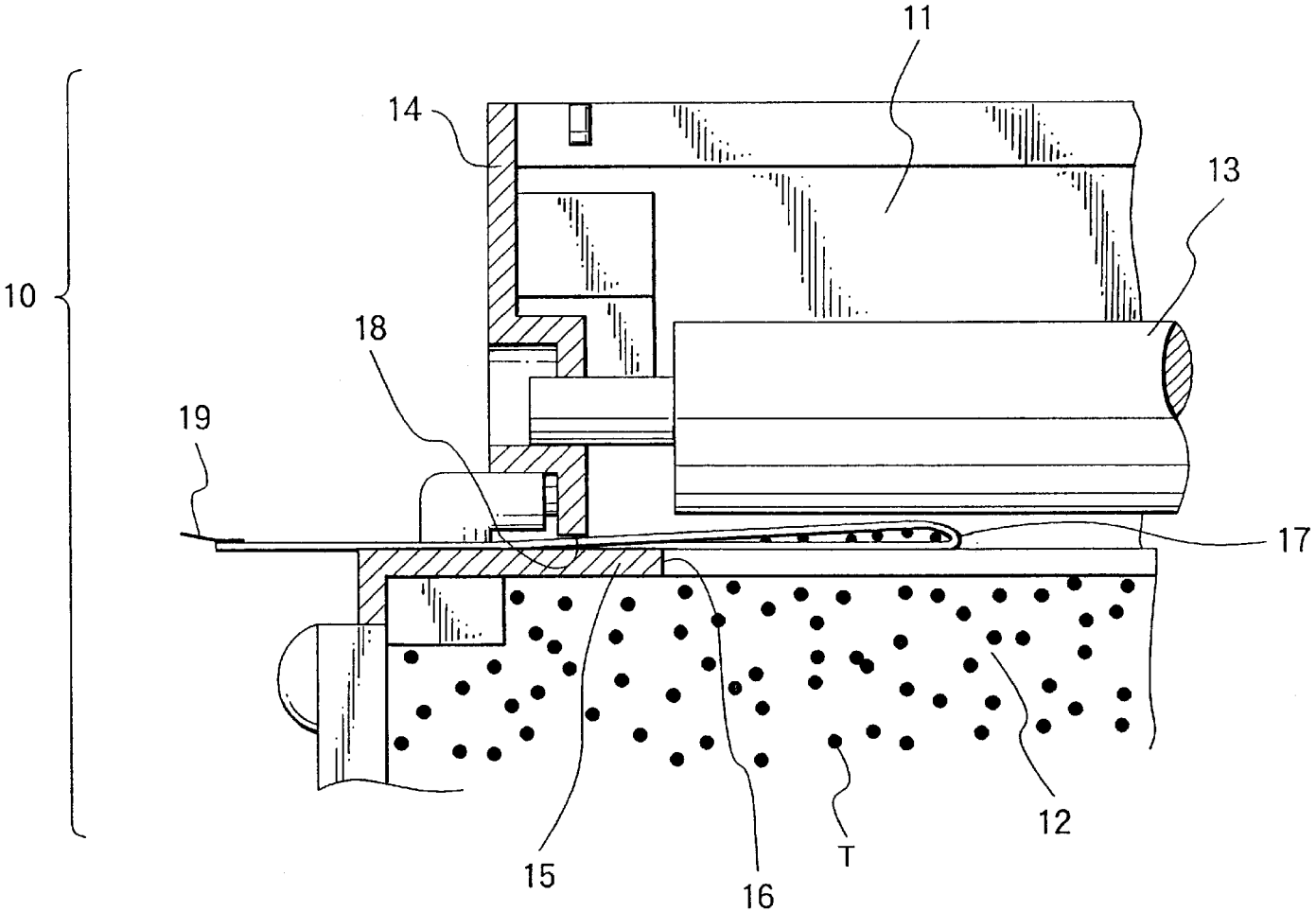
FIG. 1 PRIOR ART
FIG. 1 is a partial horizontal sectional view of a conventional toner cartridge.
Figure 2:
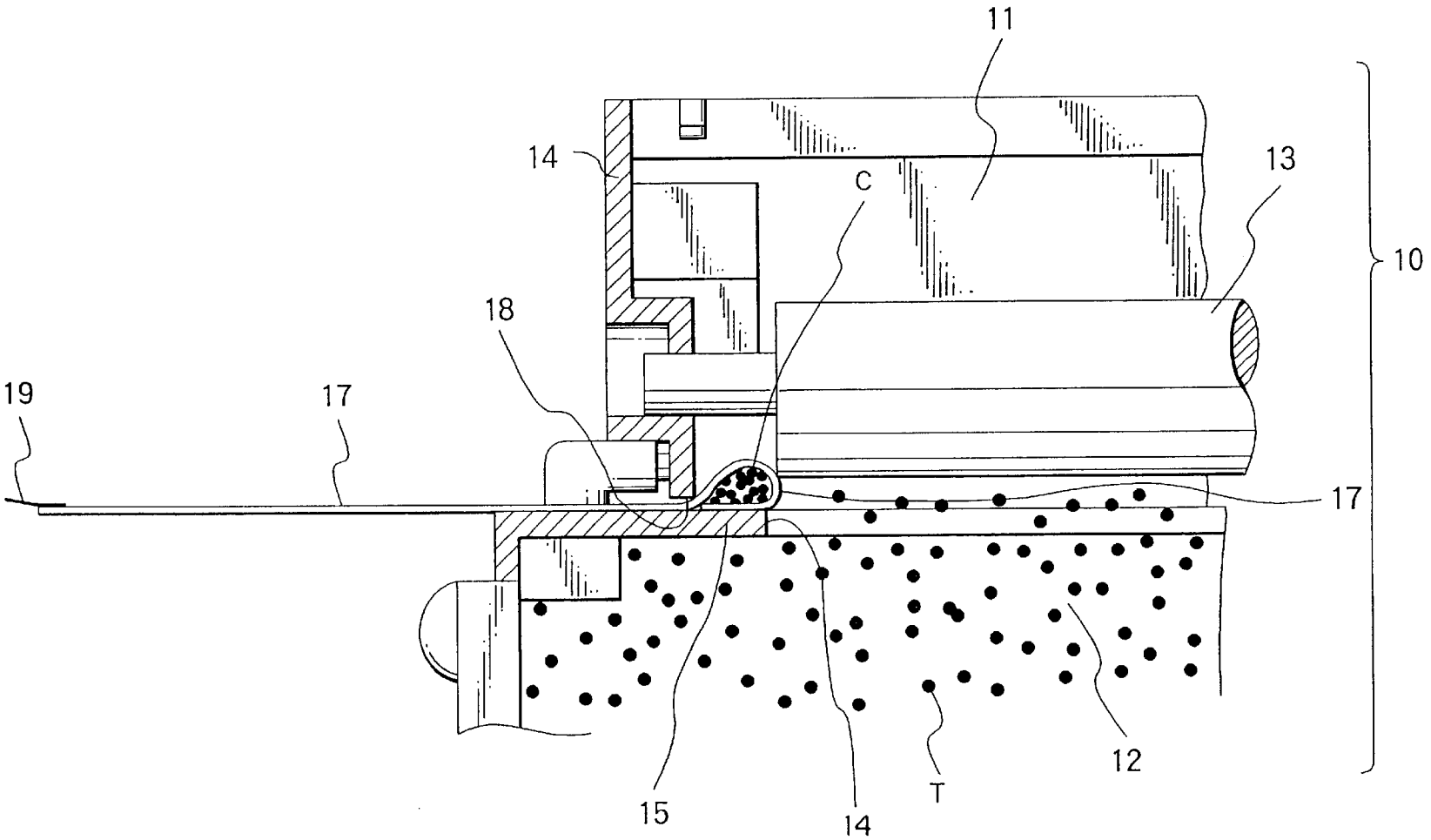
FIG. 2 PRIOR ART
FIG. 2 is a partial horizontal section view for describing a fault of the conventional toner cartridge of FIG. 1.

Referring to FIGS. 1 and 2, description will be at first directed to a conventional toner cartridge for a better understanding of this invention.

FIG. 1 shows a partial horizontal sectional view of the conventional toner cartridge. In FIG. 1, the conventional toner cartridge 10 has a developing chamber 11 and a toner chamber 12. While the developing chamber 11 contains a developing machine for an electrophotographic process, the toner chamber 12 holds toners T used for developing in the developing machine. The developing machine includes a developing roller 13 which is supported by a pair of side walls (only one shown) 14. The developing chamber 11 and the toner chamber 12 are divided by a flat partition 15. The flat partition 15 has a toner supplying opening 16 facing toward the developing roller 13 to supply the toners T from the toner chamber 12 to the developing roller 13.

When the toner cartridge 10 is in an unused state, a sealing film 17 seals or closes the toner supplying opening 16. Though the sealing film 17 is pasted to the partition 15, it is easily peeled from the partition 15. To draw the sealing film 17 from the developing chamber 11, a drawing opening 18 is formed in one of the side walls 14.

The sealing film 17 has a ribbon shape comprising first and second parts that are continuous with each other. While the first part has a first end at one end of the sealing film 17, the second part has a second end at the other end of the sealing film 17. The first part is pasted to the partition 15 at a side of the developing chamber 11 to seal the toner supplying opening 16. In this state, the first edge is located near the drawing opening 18 in the developing chamber 11. The sealing film 17 is bent at a boundary area between the first part and the second part to lay the second part on the first part. In this state, the second edge is located out of the developing chamber 11 through the drawing opening 18.

A handle member 19 is attached to the second end. If the handle member 19 is drawn toward the left side of FIG. 1, the second part is drawn from the development chamber 11 through the drawing opening 18. In this event, by drawing the second part, the first part is gradually peeled from the partition 15. The peeling progresses from the right side to the left side of FIG. 1. Then, the first part is drawn form the development chamber 11 through the drawing opening 18 after the second part.

When the first part is peeled from the partition 15, the toner supplying opening 16 opens and toners T partially pour into the developing chamber 11. The toners that pour into the developing chamber 11 fall on the first part of the sealing film 17. Moreover, it is possible that other toners, which are used to test the developing machine, remain on the first part. The toners on the first part are gathered toward the first end in a bent section of the sealing film 17 as shown in FIG. 2. The gathered toners C become trapped and prevent the sealing film from completely passing through the drawing opening 18. In the worst case, the sealing film 17 breaks in two and one piece remains in the developing chamber 11. This is because the flat partition 15 has a flat surface that partially provides the drawing opening 18.

Referring to FIGS. 3 through 7, the description will proceed to a toner cartridge according to a preferred embodiment of this invention.

Figure 3:
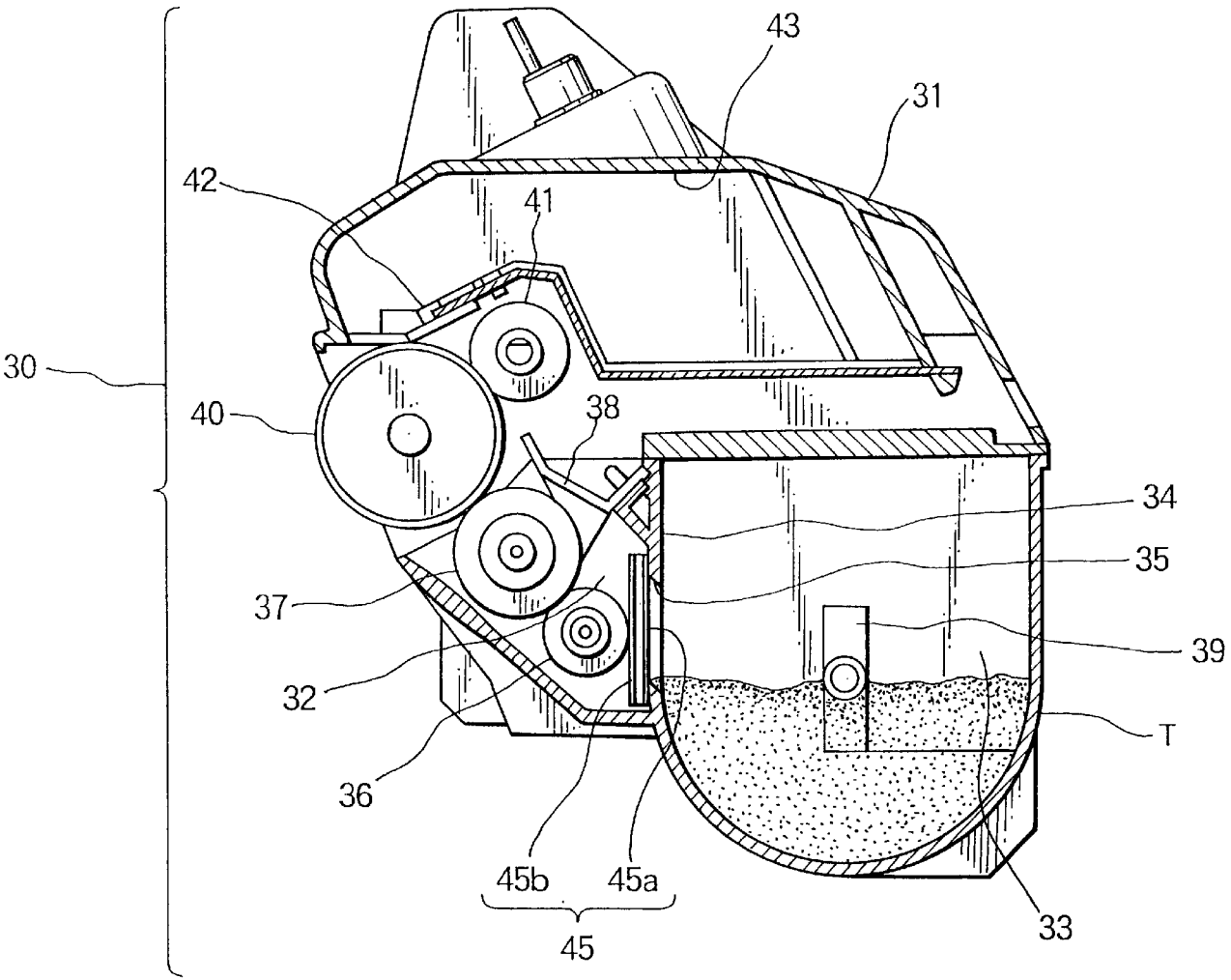
FIG. 3 is a vertical sectional view of a toner cartridge according to a preferred embodiment of this invention.

FIG. 3 shows a vertical sectional view of the toner cartridge. In FIG. 3, the toner cartridge 30 comprises a body 31 that contains a processing machine for an electrophotographic process. The processing machine comprises a developing machine. The body 31 provides a developing chamber 32 for containing the developing machine, and a toner chamber 33 for holding toners T. The developing chamber 32 and the toner chamber 33 are divided by a partition 34 having a toner supplying opening 35. The developing machine includes a toner supplying roller 36, a toner carrying roller 37, and thin layer forming member 38. The toner chamber 33 contains a stirrer 39 to stir the toners T. The processing machine further comprises a photo conductor drum 40, a brush charger 41, a cleaning member 42, and a waste toner chamber 43.

When the toner cartridge 30 is used in an electrophotographic printer, each part of the toner cartridge 30 operates as follows.

The brush charger 41 has a cylindrical brush, which is made of semiconducting fiber. The cylindrical brush partially keeps contact with a peripheral surface of the photo conductor drum 40. The peripheral surface is made of a photo conductor that is made of an OPC (optical conductive material) or selenium (Se) system material. While the brush charger 41 rotates at a constant rotation speed, the photo conductor drum 40 rotates at another constant rotation speed. Accordingly, the brush charger 41 brushes the peripheral surface of the photo conductor drum 40 with the cylindrical brush. In this event, the brush charger 41 is supplied with superimposed voltage such that AC voltage is superimposed on DC voltage to give electrostatic charges to the photo conductor drum 40. As a result, the cylindrical brush uniformly gives electrostatic charges on the peripheral surface of the photo conductor drum 40.

Next, the photo conductor drum 40 is partially exposed by a light beam supplied from a light source (not shown) which is located in the electrophotographic printer to form an electrostatic latent image. The light source is, for example, a laser or an LED and driven according to image data to form the electrostatic latent image. The light source may be combined with, for example, a liquid crystal mask (not shown) to partially block the light beam instead of the driving according to the image data.

On the other hand, the stirrer 39 supplies the toners T gradually to the toner supplying roller 36. The toner supplying roller 36 has a spindle which is made of, for example, an aluminum and has a conductive or insulating sponge member bound on the spindle. The toner carrying roller 37 has a periphery which is made of flexible material, such as silicone rubber, urethane rubber, nitril-butadien rubber, natural rubber, or sponge. The sponge member of the toner supplying roller 36 partially keeps contact with the periphery of the toner carrying roller 37. The toner supplying roller 36 rotates and supplies the toners T laid on the sponge member to the toner carrying roller 37. The thin layer forming member 38 makes the toners T laid on the periphery into a thin toner layer when the toner carrying roller 37 rotates. In this event, the thin layer forming member 38 gives electrostatic charge to the toners T of the thin toner layer by rubbing between them. The thin layer forming member 38 is, for example, at least one of leaf springs which are made of, for example, stainless steel, phosphor bronze, or nickel silver.

The toner carrying roller 37 is located at a distance from the photo conductor drum 40. With the rotation of the toner carrying roller 37, the charged toners T face the photo conductor drum 40. The electrostatic latent image formed on the photo conductor drum 40 attracts the charged toners T by electric force between them. The charged toners T cling to the photo conductor drum 40 according to the electrostatic latent image. Namely, the toners T develop the electrostatic latent image to form a toner image. The toner image is transferred to a recording medium by a transfer unit (not shown) of the electrophotographic printer. The recording medium is, for example, a paper, a film for an OHP (overhead projector), a postcard, or the like.

After the transferring, waste toners remaining on the photo conductor drum 40 are scraped from the photo conductor drum 40 by the cleaning member 42 and thrown into the waste toner chamber 43.

Thus, the toner cartridge operates in the electrophotographic printer.

In the following, the body is described in more detail.

As mentioned above, the body provides the developing chamber 32 and the toner chamber 33 and has the partition 34 for dividing the developing chamber 32 and the toner chamber 33. The partition 34 has a main surface facing to the developing chamber 32 and has the toner supplying opening 35 surrounded by the main surface. When the toner cartridge is set into the electrophotographic printer, the partition 34 stands along a vertical direction or an up and down direction of FIG. 3. Namely, the main surface is parallel to the vertical direction.

Figure 4:
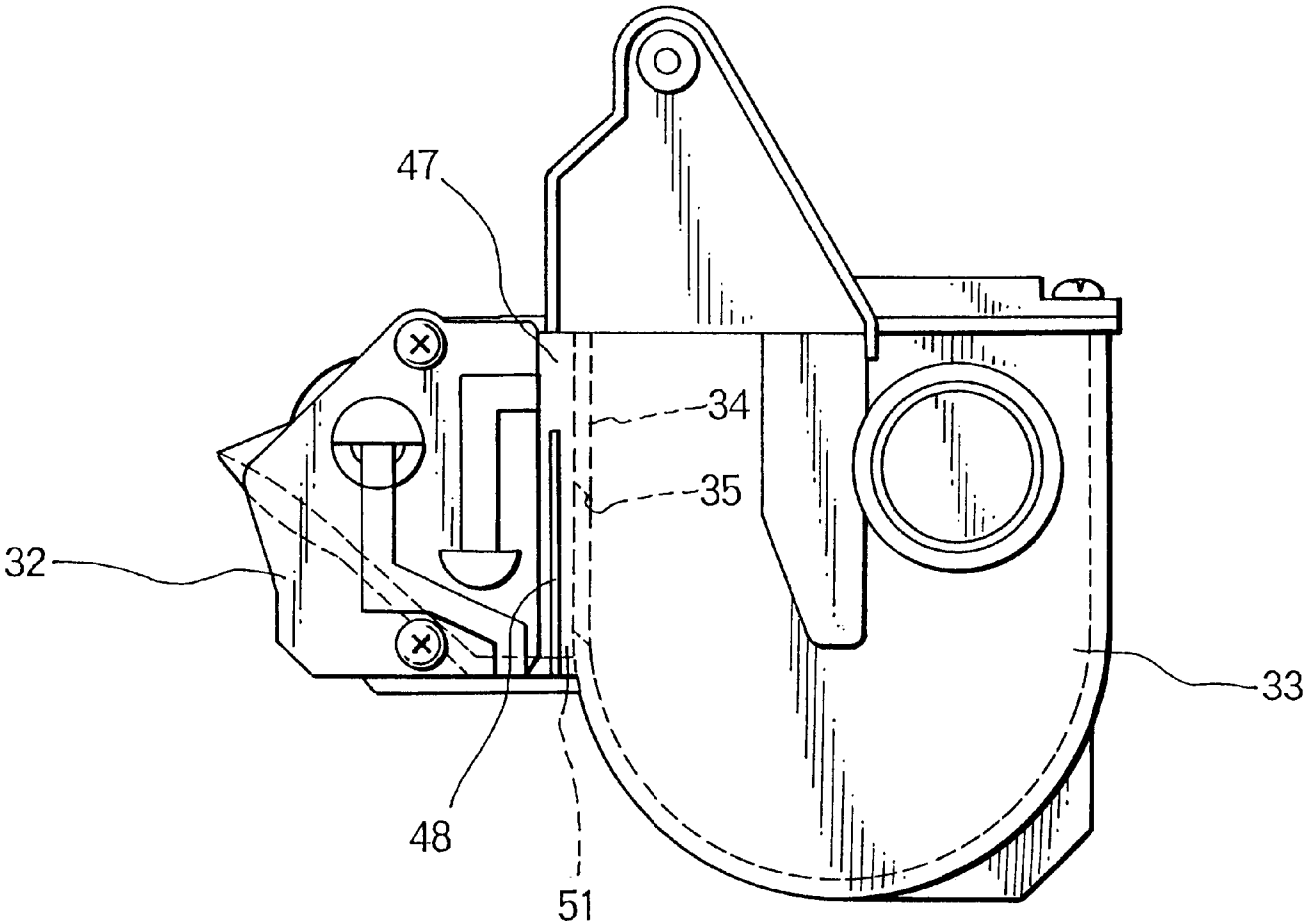
FIG. 4 is a partial side view of the toner cartridge of FIG. 3.

As shown in FIG. 4, the body includes a side wall 47, which is practically perpendicular to the main surface, to partially enclose the developing chamber 32 and the toner chamber 33. The side wall has a drawing opening 48 which leaves the developing chamber 32. The drawing opening 48 is, for example, a slit which is parallel to the main surface.

Figure 5:
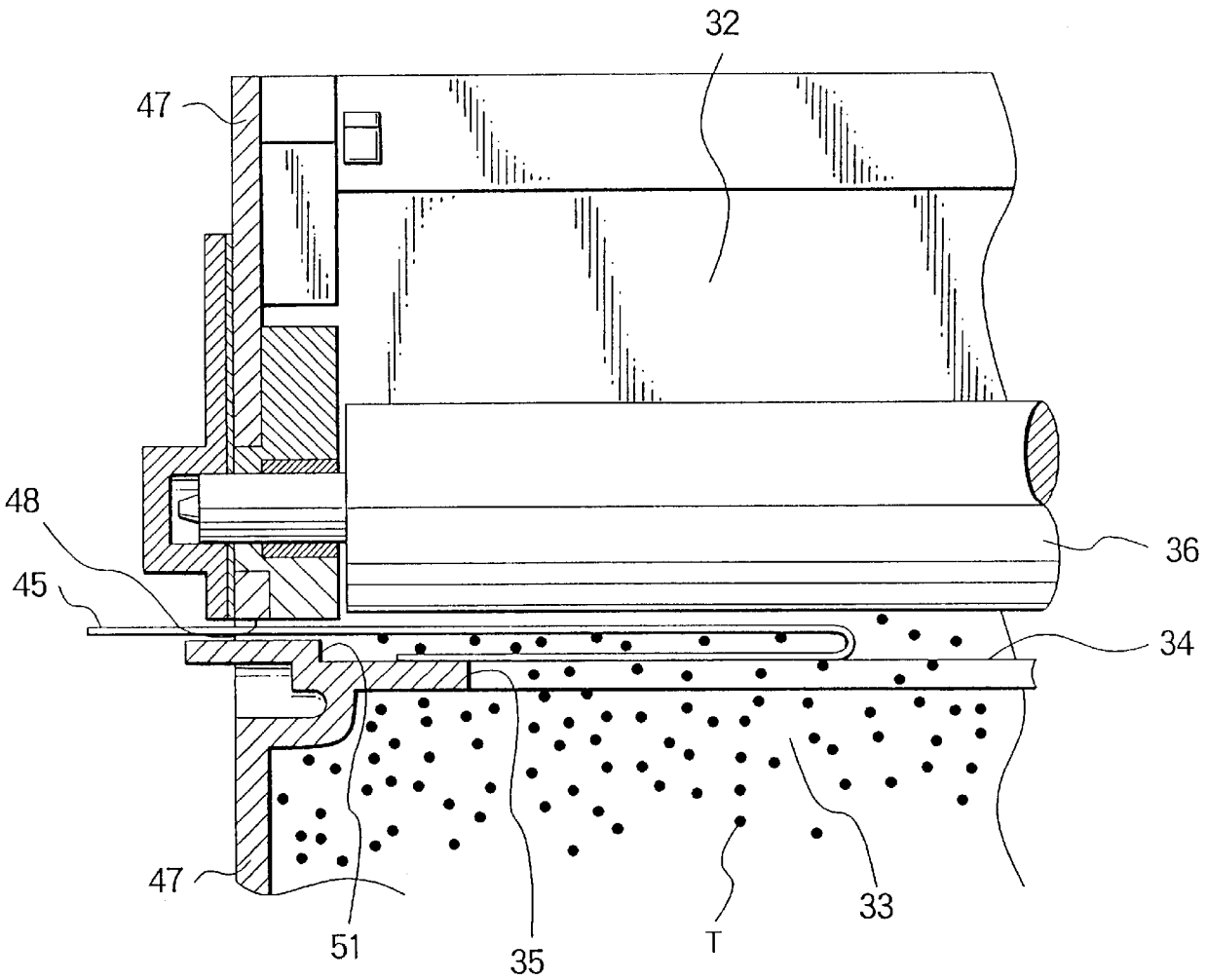
FIG. 5 is a partial horizontal sectional view of the toner cartridge of FIG. 3.

In FIG. 5, a step 51 is formed on the partition 34 between the drawing opening 48 and the toner supplying opening 35. The step projects into the developing chamber 32. The step 51 has a height of about 3 mm. The step 51 is continuous with the drawing opening 48.

Returning to FIG. 3, the toner supplying opening 35 has a rectangular shape or a racetrack shape. Namely, the toner supplying opening 35 has a width parallel to the front and back direction of FIG. 3 and a length which is parallel to the up and down direction of FIG. 3 and which is smaller than the width. The toner supplying opening 35 is sealed by a sealing film 45 to seal the toners T into the toner chamber 33 when the toner cartridge 30 is in an unused state.

The sealing film 45 has a ribbon shape and a length larger than double the width of the toner supplying opening 35. The sealing film 45 comprises a first part 45*a* and a second part 45*b* that are continuous with each other. While the first part has a first end at one end of the sealing film 45, the second part has a second end at the other of the sealing film 45. The first part 45*a* is pasted on the main surface of the partition 34 to seal the toner supplying opening 35. In this state, the first end is located near the drawing opening 48. To be precise, the first end is located near the step 51 as shown in FIG. 5. The first part 45*a* is easily peeled from the main surface. The sealing film is bent at a boundary area between the first part 45*a* and the second part 45*b* to lay the second part 45*b* on the first part. In this state, the second end is located out of the developing chamber 32 through the drawing opening 48.

Figure 6:
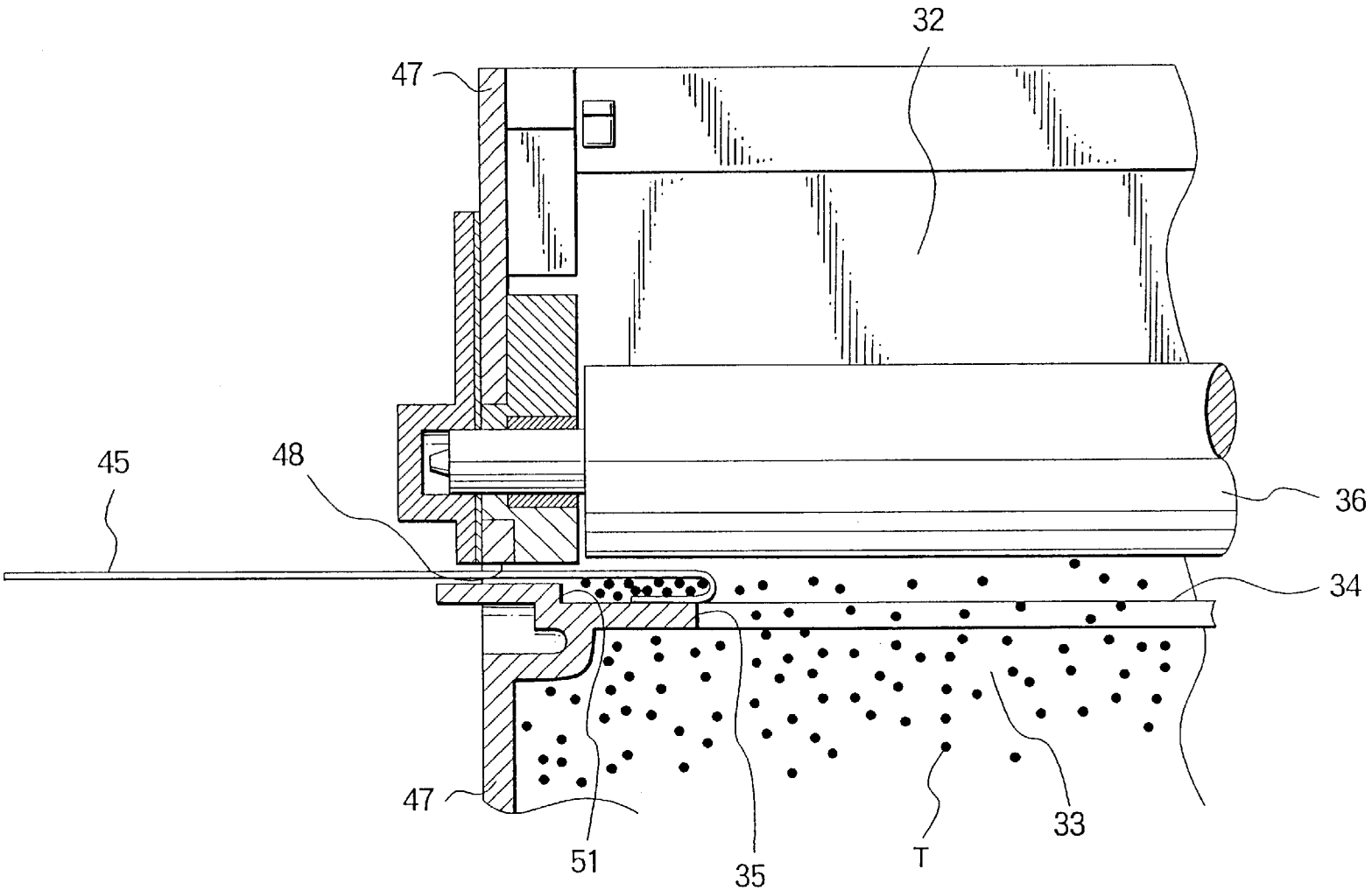
FIG. 6 is a partial horizontal sectional view for describing a process of drawing a sealing film from a developing chamber of the toner cartridge of FIG. 3.

If the toner cartridge is used in the electrophotographic printer, the sealing film must be removed from the developing chamber 32 to open the toner supplying opening 35. To remove the sealing film, the second part is drawn toward the left side of FIG. 5. When the second part is drawn out from the developing chamber 32 through the drawing opening 48, the first part is gradually peeled from the main surface. Namely, the toner supplying opening 35 is gradually opened from the right side to the left side of FIG. 5. As a result, the toners T partially pour into the developing chamber 32 from the toner chamber 33 and fall on the first part 45*a*. At the same time, a bent section of the sealing film 45 moves on the first part toward the first end. Accordingly, the bent section gathers the fallen toners as shown in FIG. 6. In this event, if there have remaining toners that are fallen on the first part by a printing test, these toners are gathered together with the fallen toners.

Figure 7:
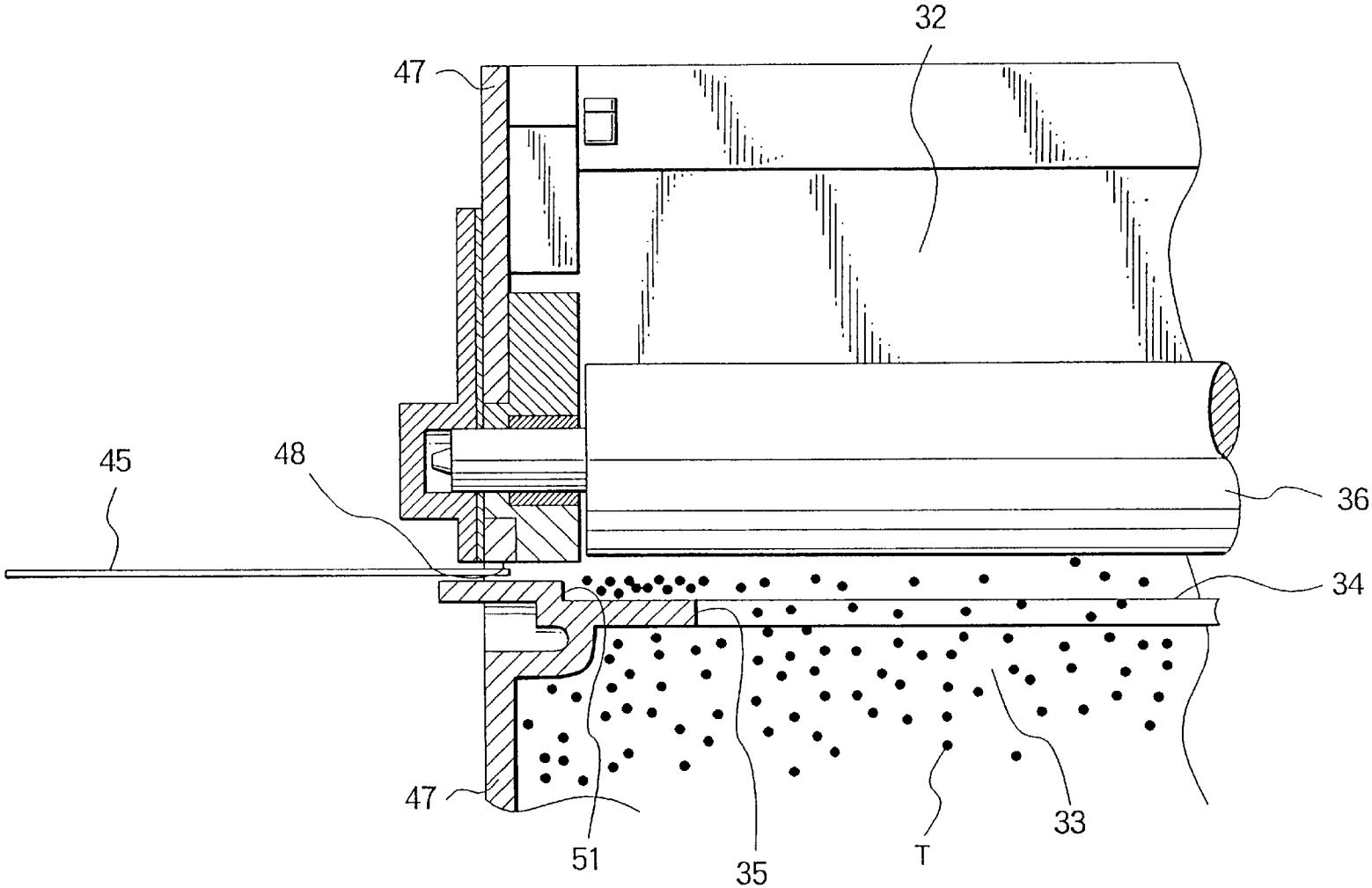
FIG. 7 is a partial horizontal sectional view for describing another process of drawing a sealing film from a developing chamber of the toner cartridge of FIG. 3.

In FIG. 6, the step 51 forms an escape space over the main surface of the partition 34 so that the gathered toners escape from the bent section. The gathered toners fall on a bottom of the developing chamber 32 through the escape space. Therefore, the sealing film 45 is smoothly drawn from the developing chamber 32 through the drawing opening without obstruction of the gathered toners as shown in FIG. 7. Namely, the sealing film 45 is completely drawn from the developing chamber 32 without breaking.

While this invention has thus for been described in conjunction with the preferred embodiment thereof, it will readily be possible for those skilled in the art to put this invention into practice in various other manners. For example, the second part 45*b* of the sealing film 45 may be glued to the first part 45*a*. In this case, the second part 45*b* may be smaller than the first part 45*a* in width.

Figure 8:
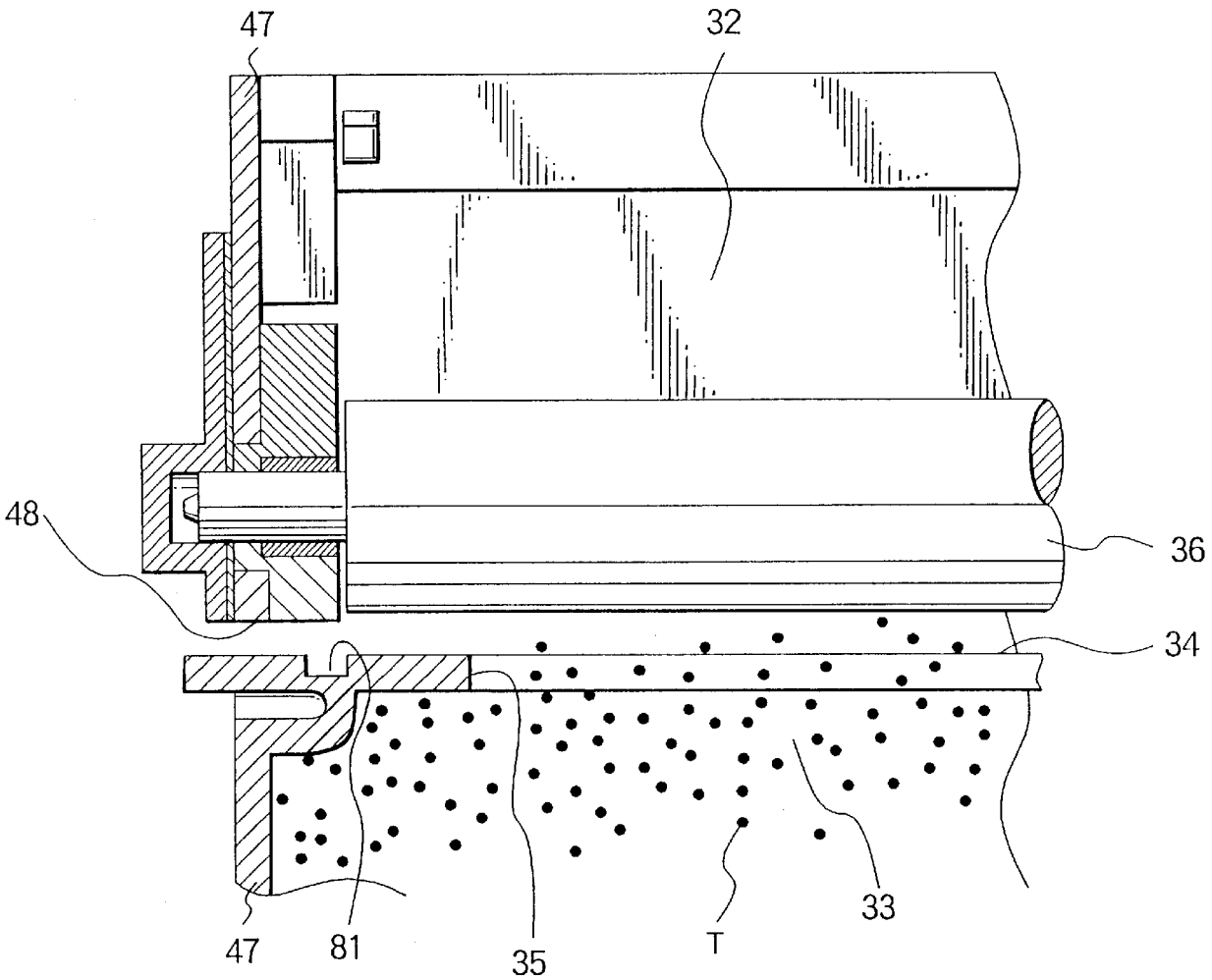
FIG. 8 is a partial horizontal sectional view of a toner cartridge according to another embodiment of this invention.
Figure 9:
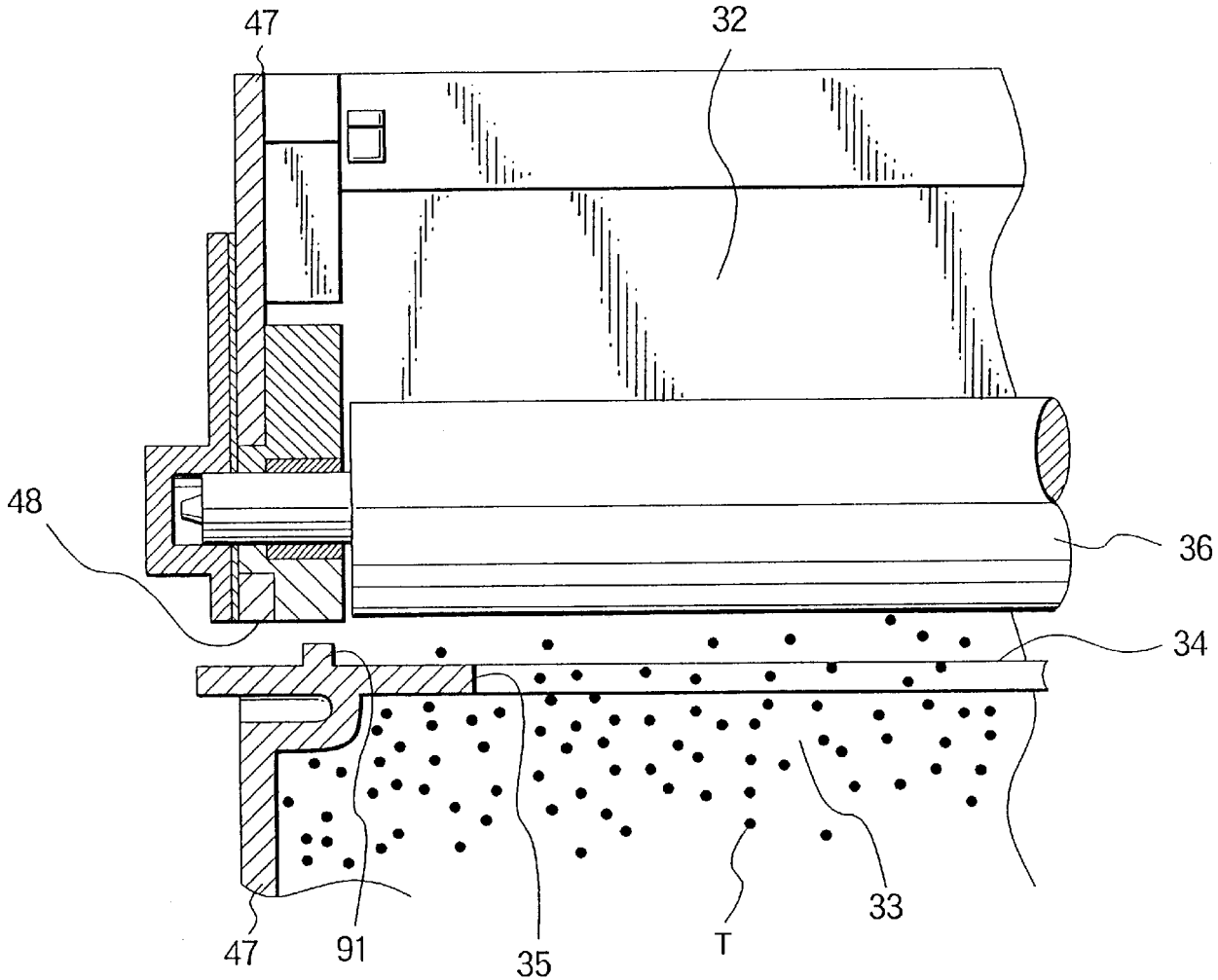
FIG. 9 is a partial horizontal sectional view of a toner cartridge according to still another embodiment of this invention.
Figure 10:
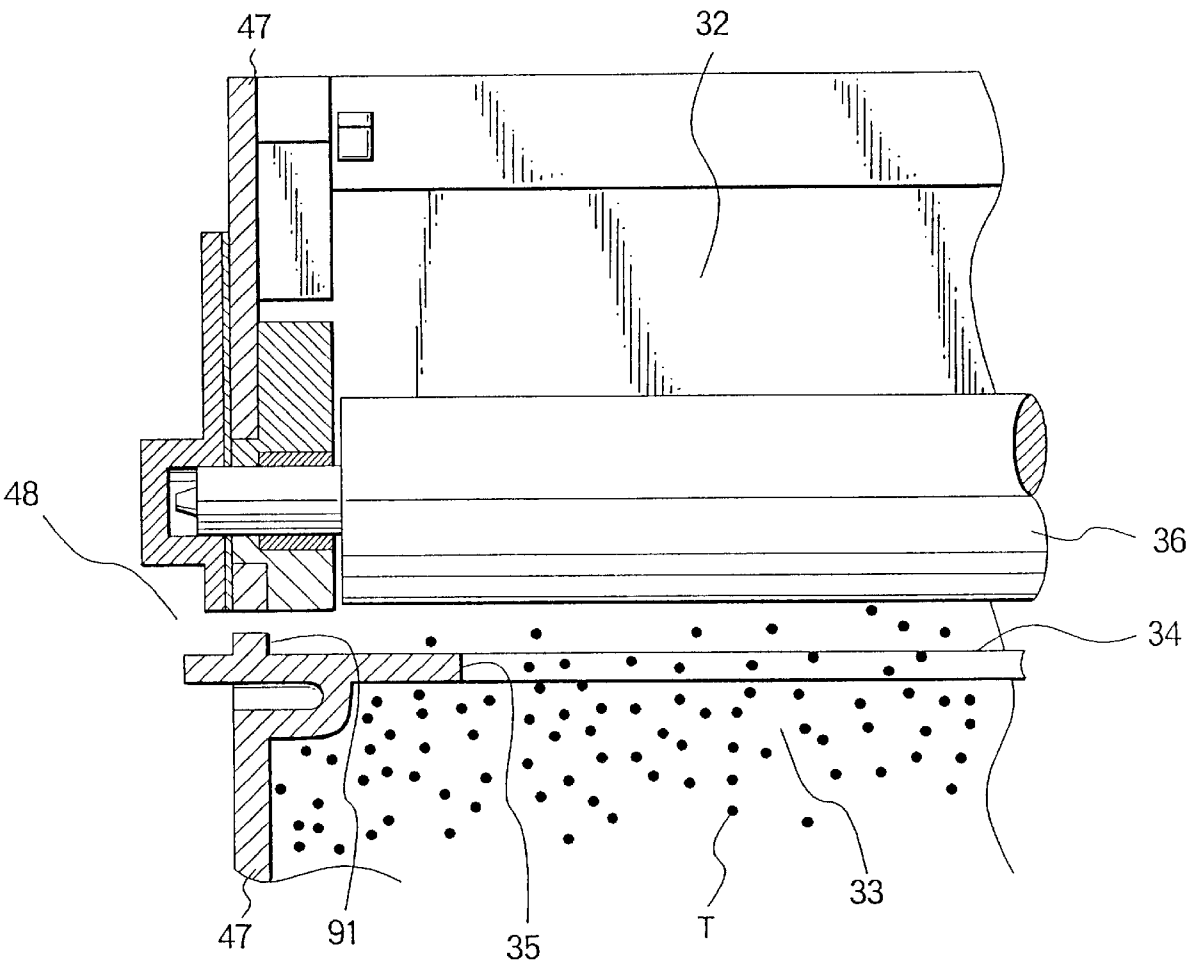
FIG. 10 is a partial horizontal sectional view of a toner cartridge according to a further embodiment of this invention.

Moreover, the partition 34 may have a groove 81 parallel to the side wall 47 instead of the step 51 as shown in FIG. 8. In addition, the partition 34 may have a projection 91 instead of the step 51 as shown in FIG. 9. The projection 91 is parallel to the side wall 47 and has a fixed height. In this case, the projection 91 may be a part of the side wall as shown in FIG. 10. Furthermore, the projection 91 may have a sloped top surface. This is easily realized by forming the drawing opening 48 which is inclined against the main surface of the partition 34 as shown in FIG. 11.

Figure 11:
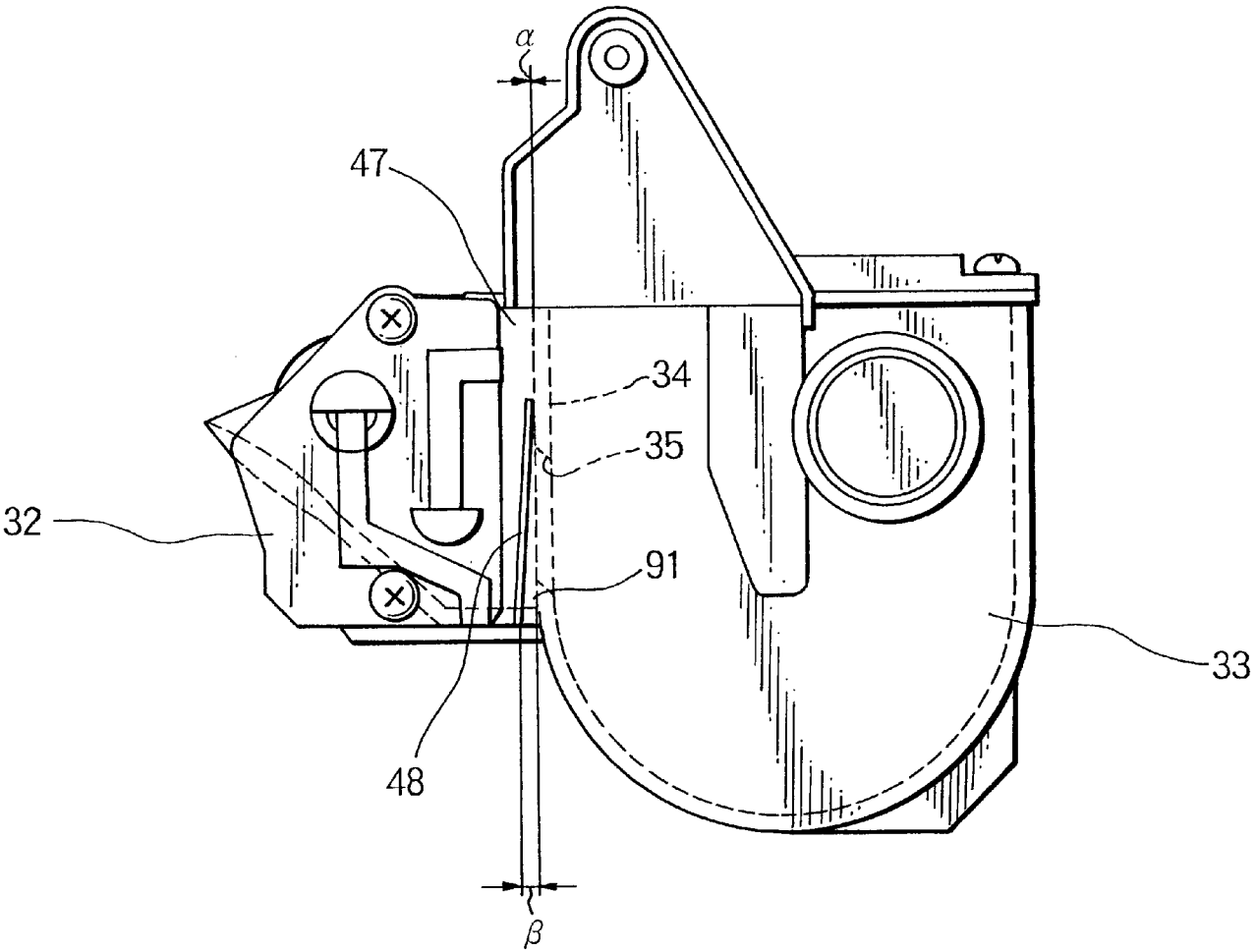
FIG. 11 is a partial side view of a toner cartridge according to an additional embodiment of this invention.

In FIG. 11, the drawing opening 48 has upper and lower end. While the upper ends is at a distance of $\alpha$ from the main surface, the lower end is at a distance of $\beta$, which is larger than $\alpha$, from the main surface. When the sealing film 48 is drawn out of the developing chamber 32, the fallen toners on the first part are gathered by the bent section and gradually fall toward the bottom of the developing chamber. Accordingly, the gathered toners escape from the bent section through the escape space formed by the projection 91. Therefore, the sealing film 45 is smoothly drawn out of the developing chamber 32 through the drawing opening 48 without breaking.

What is claimed is:

1. A toner cartridge for use in an electrophotographic printer, said toner cartridge having a developing chamber and a toner chamber holding toners, said toner cartridge comprising:

a partition located between said developing chamber and said toner chamber for dividing said developing chamber and said toner chamber, said partition having a main surface facing to said developing chamber and having a toner supplying opening through said main surface to supply said toners from said toner chamber to said developing chamber, a sealing film pasted on said main surface for closing said toner supplying opening and for sealing said toners into said toner chamber when said toner cartridge is in an unused state, said sealing film being peelable from said main surface, a side wall practically perpendicularly fixed to said partition for partially enclosing said developing chamber and having a drawing opening to draw said sealing film out of said developing chamber, and an escape means formed between said toner supplying opening and said drawing opening for gathering toners that escape from said developing chamber side of said sealing film when said sealing film is drawn out through said drawing opening.

2. A toner cartridge as claimed in claim 1, wherein said sealing film has a ribbon shape comprising first and second parts which are continuous with each other, said first part pasted on said main surface to close said toner supplying opening, and said second part bent to be laid on said first part and having an end located out of said developing chamber through said drawing opening.

3. A toner cartridge as claimed in claim 1, wherein said escape means is a step formed with respect to said main surface and projecting toward said developing chamber and into said drawing opening.

4. A toner cartridge as claimed in claim 1, wherein said escape means is a projection projecting from said main surface into said developing chamber.

5. A toner cartridge as claimed in claim 1, wherein said escape means is a groove formed in said partition from said main surface.

6. A toner cartridge as claimed in claim 1, said drawing opening being a slit parallel to said main surface, wherein said drawing opening is distant from the main surface so that said side wall serves as said escape means.

7. A toner cartridge as claimed in claim 1, said drawing opening being a slit, wherein said drawing opening is inclined against said main surface so that said side wall serves as said escape means.

8. A toner cartridge as claimed in claim 7, said slit having an upper end and a lower end, wherein said upper end is nearer to said main surface than said lower end.

9. A toner cartridge comprising:

a developing chamber having a side wall;

a toner chamber holding toners;

a partition disposed between the developing chamber and the toner chamber, the partition dividing the developing chamber and the toner chamber, the partition having a main surface facing toward the developing chamber;

a toner supply opening formed through the main surface of the partition for supplying toners from the toner chamber to the developing chamber;

the side wall having an opening, the side wall having an edge defining a side of the opening and being disposed at one end of the partition and proximate the main surface;

a sealing film having a toner chamber side and an opposed developing chamber side and affixed on said toner chamber side to the main surface to close the toner supply opening for sealing the toners within the toner chamber when the toner cartridge is in an unused state, the sealing film being peelable from the main surface to permit toner to be supplied from the toner chamber to the developing chamber, the sealing film being bent upon itself to form a bent section for peeling the film from the main surface and removing the film through the opening through the side wall; and a step disposed between the edge of the side wall and the main surface, the step forming an escape for toner gathered within the bent section of the sealing film during peeling of the film from the main surface.

10. A toner cartridge as claimed in claim 9, wherein the step projects from the main surface toward the developing chamber.

11. A toner cartridge as claimed in claim 9, wherein the step projects into the main surface away from the developing chamber.

12. A toner cartridge as claimed in claim 9, wherein the edge of the side wall and the main surface are formed in a common plane.

13. A toner cartridge as claimed in claim 9, wherein the edge of the side wall has a length, and the step is continuous substantially along the length of the edge.

14. A toner cartridge as claimed in claim 9, wherein the edge of the side wall is parallel to the main surface.

15. A toner cartridge as claimed in claim 9, wherein the edge of the side wall is inclined with respect to the main surface.

16. A toner cartridge as claimed in claim 9, wherein the side wall comprises the step.

* * * * *